United States Patent [19]

Fisher et al.

[11] 4,085,924

[45] Apr. 25, 1978

[54] COOLING ASSEMBLY FOR METALLURGICAL VESSELS

[75] Inventors: Howard M. Fisher; Harry T. Montgomery, both of New Castle, Pa.

[73] Assignee: Pennsylvania Engineering Corporation, Pittsburgh, Pa.

[21] Appl. No.: 815,792

[22] Filed: Jul. 15, 1977

[51] Int. Cl.[2] ..... C21C 5/42

[52] U.S. Cl. ..... 266/241

[58] Field of Search ..... 266/241, 243, 245, 246; 75/60

[56] References Cited

U.S. PATENT DOCUMENTS 3,817,504 6/1974 Vonnemann ..... 266/241

*Primary Examiner*—Gerald A. Dost

*Attorney, Agent, or Firm*—Fred Wiviott

[57] ABSTRACT

An open topped, refractory lined metallurgical converter vessel has a metallic shell. A cooling jacket is affixed to the frusto-conical nose portion of the shell and comprises a plurality of right angle members affixed to the shell in a side-by-side relation and extending generally in the axial direction. The members have their edges affixed to the shell surface to form a flow passage therewith. A manifold pipe extends partially around the vessel and is connected to all of the flow passages except for those above and adjacent to the tap nozzle which are connected to a drain manifold. Plate sections are affixed to the upper end of the angle members and to the shell to define a nose cooling ring which is connected to the upper end of each angle section to define a return flow path for cooling water. Baffles are disposed in the nose cooling ring adjacent the margins of the angle members which are connected to the drain manifold to insure filling of the system.

10 Claims, 5 Drawing Figures

COOLING ASSEMBLY FOR METALLURGICAL VESSELS

BACKGROUND OF THE INVENTION

This invention relates to cooling assemblies for metallurgical converter vessels.

Pneumatic type metallurgical converters commonly include a generally pear-shaped vessel which is open at its upper end. Means are commonly provided for delivering oxygen to a molten charge contained within the vessel. The oxygen delivery system may include, for example, a lance which extends through the open mouth of the vessel or tuyeres which extend through the vessels bottom or sides. It is a common practice to cool the upper portion of such metallurgical vessels to minimize thermal deformation which could otherwise result from the high temperatures to which this portion of the vessel is exposed. Such cooling arrangements commonly take the form of pipes or hollow panels affixed to or adjacent the vessel surface. In addition, hollow means for receiving cooling fluid are often disposed in surrounding relation to the vessel mouth.

Water cooling of the areas of excessive elevated temperatures is desirable to stabilize external thermal distortion of the plates which define the outer metallic shell. Such distortion results from overheating of a particular area in relation to adjacent areas while the entire shell is subjected to mechanical stress from the molten metal within the furnace, the support loads and the external pressure due to thermal expansion of the lining refractory. Overheating can be caused by conductive heat transfer from the inside of the vessel and through the refractory, particularly when the refractory has been worn thin, intense radiant heat such as that experienced around the vessel tap nozzle, as well as external spills and slag spitting.

Some prior art nose cooling assemblies are unsatisfactory because they do not insure substantially uniform cooling either because all surfaces of the cooling system do not receive cooling water or because of the serial passage of cooling liquid through successive portions of the system.

SUMMARY OF THE INVENTION

It is an object of the invention to provide a new and improved cooling assembly for metallurgical converter vessels.

A further object of the invention is to provide a cooling assembly wherein the flow of cooling fluid to all portions of the system is insured.

Another object of the invention is to provide a cooling assembly for metallurgical vessels wherein cooling liquid flows in a parallel relation in substantially all portions of the system to provide substantially more uniform temperatures.

These and other objects and advantages of the present invention will become more apparent from the detailed description thereof taken with the accompanying drawings.

DETAILED DESCRIPTION OF THE PREFERRED EMBODIMENT

Figure 1:
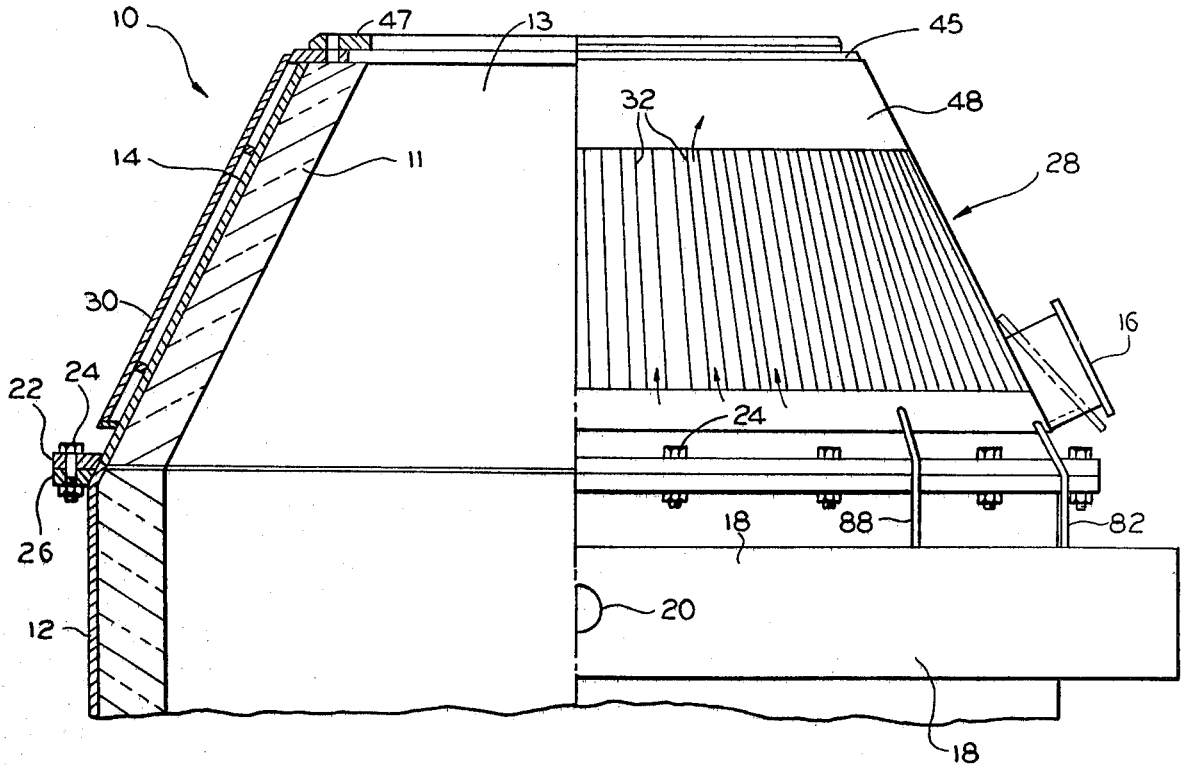
FIG. 1 is an elevational view of the upper portion of a metallurgical converter vessel incorporating the cooling assembly of the present invention.

FIG. 1 shows the upper portion of a metallurgical vessel 10 of the type wherein oxygen is injected into a molten metallic charge for the purpose of oxidizing undesirable constituents. While only a portion of the vessel is shown, it will be appreciated that it includes a refractory lining 11 and a metallic shell 12. In addition, the vessel is generally pear-shaped and has an opening 13 at its upper end for receiving a metallic charge. The upper section 14 of the shell 12 tapers upwardly and inwardly toward the opening 13 and is commonly referred to as a nose cone.

Vessels of the type illustrated in FIG. 1 are commonly mounted for pivotal movement about a horizontal axis so that they may be tilted for receiving a charge or for discharging metal through a tap nozzle 16. Toward this end, the vessel 10 may be mounted on a trunnion ring 18 which has a pair of trunnion pins 20 extending from its opposite sides. The vessel 10 may be affixed to trunnion ring 18 by suitable brackets which are not shown but are well known in the art. The trunnion pins 20 may be supported by suitable bearings (not shown) and are coupled to a tilt mechanism (not shown).

The frusto-conical nose cone portion of the outer shell 14 is formed of steel plate and has a flange 22 at its lower end which permits attachment by means of bolts 24 to a mating flange 26 disposed at the upper end of the remaining portion of the furnace shell. A cooling assembly 28 according to the present invention is affixed to the nose cone shell portion 14.

The cooling assembly 28 comprises a plurality of individual right angle members 32 having legs of equal length which are suitably affixed to the shell portion 14 such as by welding. The members 32 may be disposed in a side-by-side manner or with a gap therebetween. In either event, they may be tapered from their lower to their upper end.

Figure 3:
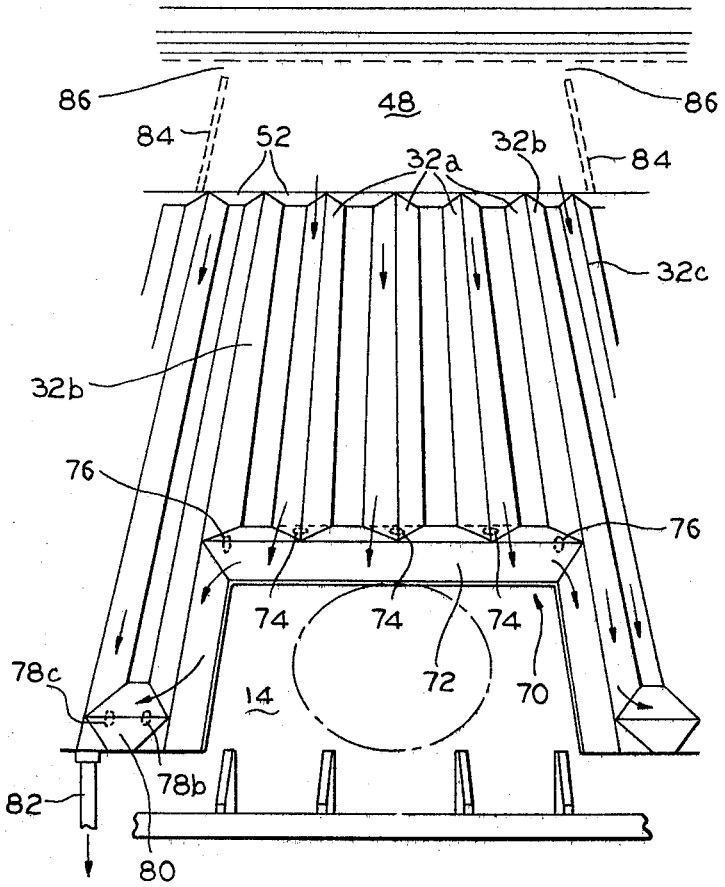
FIG. 3 is a fragmentary view taken along lines 3—3 of FIG. 2.
Figure 4:
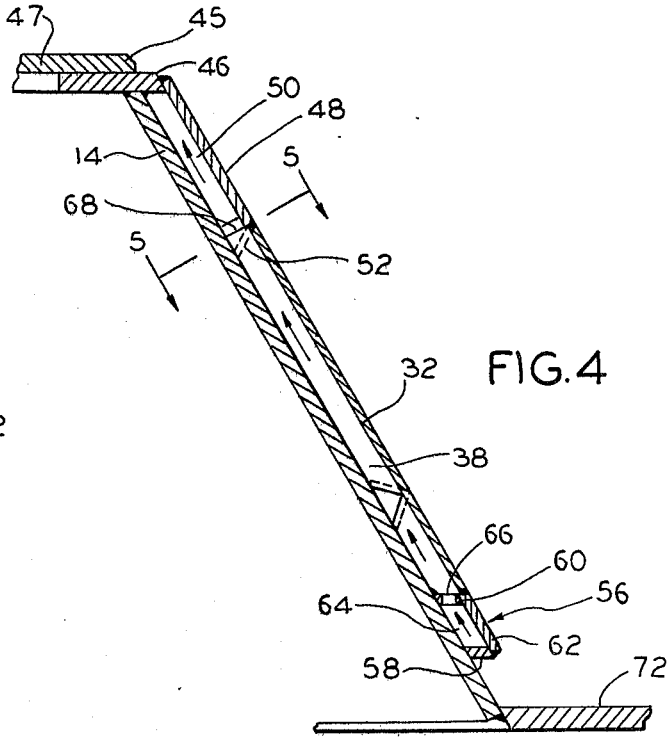
FIG. 4 is a view taken along lines 4—4 of FIG. 2.
Figure 5:
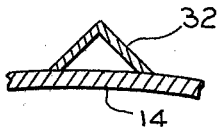
FIG. 5 is a view taken along lines 5—5 of FIG. 4.

Affixed to the upper end of the shell portion 14 and extending radially relative to the axis of the vessel is a nose ring 45. As seen in FIG. 3, the lower surface of the nose ring 45 is welded to the upper end of shell section 14 at a point displaced inwardly from its outer periphery. This defines a radially outwardly extending flange 46 which surrounds the upper end of shell portion 14. Also affixed to the upper surface of ring 45 is a second ring 47 having a smaller diameter.

An arcuate plate 48 which is a segment of a frusto-conical section is secured above each cooling member 32 to define a hollow passage 50 with the shell portion 14, the members 32 and the ring 45. More specifically, plate 48 is affixed at its upper end to the outer periphery 46 of the nose ring 44 and at its lower end to the apexes of the members 32. Since the members 32 are triangular in transverse cross-section and spaced apart, shaped closure blocks 52 are disposed in the gaps between members 32 and plate 48.

A manifold 56 is secured to the shell portion 14 and communicates with the lower ends of members 32. Specifically, manifold 56 includes a pair of substantially arcuate members 58 and 60 which are affixed to the surface of shell portion 14 in a generally equidistantly spaced apart relation and are parallel relative to each other and to the ring flange 22. An arcuate plate 62 which is coextensive with the members 58 and 60 is secured to the outer peripheries of members 58 and 60 and is oriented in spaced apart parallel relation relative to the surface of shell portion 14. This defines an arcuate passage 64 and disposed below and arranged generally normally to the passages 38 defined by members 32. The members 58 and 60 and the plate 64 span the cooling assembly except for those members 32 adjacent tap nozzle 16. In addition, the lower ends of members 32 are secured in a water tight relation to member 60 and member 60 has an opening 66 which is in alignment with each of the flow passages 38 to place the latter in communication with the manifold passage 64. Similarly, the upper end 68 of each passage 38 is also in communication with the nose ring passage 50.

As seen in FIG. 3, those members 32*a* above the nozzle 16 consist of angle members which are shorter than the remaining members 32 but are connected to the nose ring passage 50 in an identical manner. The lower ends of members 32*a* are welded to a drain manifold 70 consisting of an arcuate angle member 72 which is affixed to the shell portion 14 in a generally normal relation with respect to members 32*a*. The lower ends of the members 32*a* are welded to the upper surface of angle member 72 and there is an opening 74 in member 72 in alignment with each of the angle members 32*a* to provide communication between manifold 70 and the flow passages 38*a* within members 32*a*. In addition, the ends of manifold 72 are cut at an acute angle corresponding to one-half the apex angle of the members 32 and this cut end is welded to the adjacent surfaces of the members 32*b* which are disposed adjacent the opposite sides of the group of angle members 32*a*. In addition, an opening 76 is formed in one side of each angle member 32*b* and in alignment with the interior of manifold 70 so that manifold 70 communicates with the interior of each of the members 32*b*. Disposed adjacent each member 32*b* and the side thereof opposite the members 32*a* is an angle member 32*c*. The upper ends of the members 32*b* and 32*c* communicate with the nose ring passage 50 in the same manner as the remaining members 32. In addition, the lower ends of members 32*b* and 32*c* are closed except for openings 78*b* and 78*c* formed at the lower end of the adjacent side of these members. A shaped member 80 is affixed in the gap between the lower ends of members 32*b* and 32*c* and in alignment with openings 78*b* and 78*c* to place the members in communication. In addition, a drain pipe 82 is connected to the lower end of each member 32*c* for connection to a suitable drain.

Figure 2:
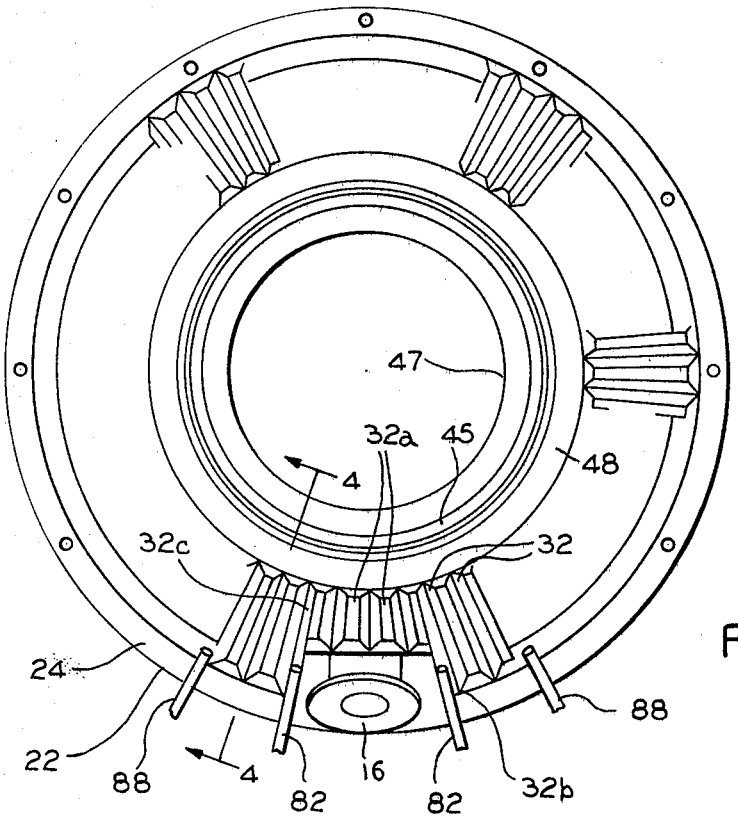
FIG. 2 is a top plan view of the vessel and cooling assembly shown in FIG. 1.

Referring now to the upper end of FIG. 3, a baffle plate 84 is affixed within flow passage 50 and is in sealing engagement with the internal surface thereof except for a gap 86 between the upper ends of baffle plates 84 and the ring 45. As seen in FIGS. 2 and 3, a supply pipe 88 extends upwardly from the trunnion ring 18 and is coupled to the supply manifold 56. The drain conduits 82 also extend downwardly into the trunnion ring 18.

Those skilled in the art will appreciate that the trunnion ring 18 is preferably hollow and includes internal piping adapted to receive cooling water. As those skilled in the art will also appreciate, water is provided to the trunnion ring piping through rotary joints coincident with the tilt axis of vessel 10 and conduits which pass coaxially through the trunnion pins 20. After passage through the trunnion pin piping, cooling water flows upwardly through conduit 88 and into the manifold 62 which, will be recalled, is connected to the lower end of each of the flow passages 38 defined by members 32. After filling the manifold 62, the water flows upwardly through all of the passages 38 in members 32 and then fills the nose ring 50 up to the level of the gap 86 between baffles 84 and nose ring 45. At this point, the water spills over the baffles 84 and flows downwardly through the passages defined by members 32*a*, 32*b* and 32*c*, through the manifold 72 and the members 80 and outwardly through drain conduits 82. It will be appreciated that because return water flow does not occur until the system is entirely full to the level of the top of the baffles 84, all of the internal cooling surfaces of the cooling assembly, and the trunnion ring will be full before return flow commences. Also, suitable valves (not shown) in the water inlet and drain systems can be employed to insure filling of the members 32*a*, 32*b* and 32*c* as well.

It can be seen that because the cooling water is supplied to all of the upwardly directed members in a parallel manner, this water temperature will be relatively more uniform than cooling assemblies wherein the water flows alternately up and down the various pipes in a series relation. Also, because there are substantially fewer drain members 32*a*, 32*b* and 32*c* than the upwardly directed flow passages 38 within members 32, a higher flow velocity will exist within members 32*a*, 32*b* and 32*c*. The latter members, of course, surround the tap nozzle 16, which is exposed to the greatest heat load so that the greater flow velocity enhances the cooling effect.

While only a single embodiment of the invention has been illustrated and described, it is not intended to be limited thereby but only by the scope of the appended claims.

I claim:

1. A metallurgical vessel having a top opening and cooling means disposed on the surface of said vessel and adjacent said top opening, a plurality of elongate members affixed to the surface of said vessel in a side-by-side relation and extending from a mid-region of said vessel toward said top opening, said members defining with the surface of said vessel a plurality of adjacent flow passages having upper ends adjacent said top opening and lower ends adjacent said mid-region, first means defining a first elongate flow passageway disposed adjacent said top opening and communicating with the upper ends of said flow passages, second means defining a second flow passageway surrounding a substantial portion of the mid-region of said vessel and communicating with the lower ends of a first portion of adjacent ones of said flow passages, drain means disposed adjacent the lower ends of the remaining ones of said flow passageway and being connected thereto, and baffle means disposed in said first flow passageway for preventing the flow of cooling water from that portion of said first flow passageway disposed above the first portion of said flow passages until the same are substantially full.

2. The apparatus set forth in claim 1 wherein said vessel includes a nose ring disposed in surrounding relation to said vessel top opening and having a peripheral margin which extends outwardly from the surface of said vessel, said first flow passageway defining means including arcuate plate means affixed at one edge to the periphery of said nose ring, the upper ends of said flow passages extending to the other edge of said plate means, and means for sealing said members to said plate means.

3. The apparatus set forth in claim 2 wherein said vessel has a tap nozzle extending from one side thereof and between said mid-region portion and said top opening, the portion of said flow passages comprising all of the flow passages except those in the region of said tap nozzle.

4. The apparatus set forth in claim 1 wherein said baffle means comprises a pair of baffle plate means disposed in said first flow passageway and in spaced relation and on the opposite sides of said remaining flow passages and a gap formed in the upper ends of said baffle plate means to permit water to flow therethrough when said first flow passageway is substantially full.

5. The apparatus set forth in claim 1 wherein each of said members is elongate and V-shaped in transverse cross-section, the edges of said members being affixed to said vessel to define said flow passages.

6. The apparatus set forth in claim 1 and including closure means disposed adjacent the lower ends of the first portion of said flow passages for closing the same, a plurality of apertures formed in said closure means and each aperture being in registry with one of said flow passages, said second means including plate means affixed to said vessel and to said closure means for defining a hollow flow passageway.

7. The apparatus set forth in claim 6 wherein said baffle means comprises a pair of baffle plate means disposed in said first flow passageway and in spaced relation and on the opposite sides of said remaining flow passages and a gap formed in the upper ends of said baffle plate means to permit water to flow therethrough when said first flow passageway is substantially full.

8. The apparatus set forth in claim 7 wherein said vessel has a tap nozzle extending from one side thereof and between said mid-region portion and said top opening, the portion of said flow passages comprising all of the flow passages except those in the region of said tap nozzle.

9. The apparatus set forth in claim 8 wherein said vessel includes a nose ring disposed in surrounding relation to said vessel top opening and having a peripheral margin which extends outwardly from the surface of said vessel, said first flow passageway defining means including arcuate plate means affixed at one edge to the periphery of said nose ring, the upper ends of said flow passages extending to the other edge of said plate means, and means for sealing said members to said plate means.

10. The apparatus set forth in claim 1 wherein each of said members is elongate and V-shaped in transverse cross-section, the edges of said members being affixed to said vessel to define said flow passages.

* * * * *